United States Patent [19]

Tamagawa et al.

[11] Patent Number: 4,904,635

[45] Date of Patent: Feb. 27, 1990

[54] HEAT-SENSITIVE RECORDING PAPER

[75] Inventors: Shigehisa Tamagawa; Tetsuro Fuchizawa, both of Shizuoka, Japan

[73] Assignee: Fuji Photo Film Co., Ltd., Kanagawa, Japan

[21] Appl. No.: 194,664

[22] Filed: May 16, 1988

[30] Foreign Application Priority Data

May 15, 1987 [JP] Japan ..... 62-118443

[51] Int. Cl.[4] ..... B41M 5/18

[52] U.S. Cl. ..... 503/207; 427/152; 428/211; 428/537.5; 428/913; 428/914; 503/200; 503/214; 503/226

[58] Field of Search ..... 427/150–152; 428/913, 211, 537.5, 914; 503/200, 226, 207, 214

[56] References Cited

FOREIGN PATENT DOCUMENTS

| | | | |
|---|---|---|---|
| 0225987 | 12/1984 | Japan | 503/226 |
| 1089883 | 5/1986 | Japan | 503/226 |
| 2183354A | 6/1987 | United Kingdom | 503/226 |

*Primary Examiner*—Bruce H. Hess

*Attorney, Agent, or Firm*—Sughrue, Mion, Zinn, Macpeak & Seas

[57] ABSTRACT

Heat-sensitive recording paper comprising a paper support onto which a heat-sensitive color-forming layer has been coated, wherein the paper support comprises a base paper having coated thereon a subbing layer comprised of a mixture of fine particles of a thermoplastic resin and a binder, thus whereby enhancement of the rate and the uniformity of contact of the heat-sensitive paper with a thermal head or like recording means is achieved.

16 Claims, No Drawings

HEAT-SENSITIVE RECORDING PAPER

FIELD OF THE INVENTION

The present invention relates to a heat-sensitive recording paper on which records can be made with a thermal head, a heat pen and the like. More particularly, it relates to a heat sensitive recording paper which does not cause sticking of a heat-sensitive color-forming layer to a thermal head and piling of a heat fusible component in a heat-sensitive color-forming layer on a thermal head, has excellent dot reproducibility even in high speed recording, and produces clear records of high density.

BACKGROUND OF THE INVENTION

Recent years have seen a remarkable development of facsimile equipment and printers. In particular, these apparatus generally employ a heat-sensitive recording system using a combination of a thermal head and a heat-sensitive recording paper comprising a colorless dye such as Crystal Violet Lactone and a phenol compound coated thereon, as described, e.g., in Japanese Patent Publication No. 14039/70.

This heat-sensitive recording system is advantageous in that the recording paper undergoes a primary color formation which requires no development, simplifies the recording apparatus, and reduces the cost of the recording paper and the recording apparatus, and that it use a quiet non-impact process. Therefore, it has held a high rank among low-speed recording methods. However, a serious drawback of heat-sensitive recording lies in the slowness of the recording speed as compared with electrostatic recording and other recording methods. Also, heat-sensitive recording has not yet extended its applicable range to include high-speed recording.

A problem in such high speed heat-sensitive recording is that sufficient heat conduction cannot be made between the thermal head and the heat-sensitive recording paper with which the thermal head is in contact, making it impossible to provide sufficient recording density. This has been a major factor that prevents the heat-sensitive recording paper from being used in high speed recording. A thermal head is an assembly of dot-shaped electrical resistance heating elements which respond to a recording signal to produce heat. When these electrical resistance heating elements are brought into contact with the heat sensitive color forming layer, the heat-sensitive color forming layer is molten to develop color. In order to provide sharp and high density recording, an excellent dot reproducibility is required. In other words, the thermal head and the heat-sensitive color forming layer need to be in close contact with each other to provide a more efficient heat conduction therebetween so that dots having a shape corresponding to that of the dot-shaped heating elements can be formed on the heat-sensitive color forming layer in fully developed colors in full response to high speed recording signals. At present, however, only a small percentage of heat produced by the thermal head is transmitted to the heat-sensitive color forming layer. Thus, the efficiency of heat conductance between the two components is still extremely low.

Heretofore, several approaches have been proposed to improve the surface smoothness of the heat-sensitive color forming layer so that the thermal head and the heat-sensitive color forming layer come into as close contact as possible with each other.

For example, Japanese Patent Publication No. 20142/77 describes a method which comprises treatment of the surface of a heat-sensitive color forming layer to a Bekk smoothness of 200 to 1,000 seconds. Japanese Patent Application (OPI) No. 115255/79 describes that when a Bekk smoothness is from 200 to 1,000 seconds, the heat-sensitive color forming layer can respond only to heat impulses of from about 5 to 6 milliseconds, and that for high-speed recording using heat impulses of not more than 1 millisecond it is necessary for the surface of the heat-sensitive color forming layer to be made smooth to such an extent that the Bekk smoothness is not less than 1,100 seconds. However, when the Bekk smoothness is increased to not less than 1,100 seconds, color fog is produced upon application of pressure. The formation of color fog is prevented by using a base paper which has been previously made smooth to an extent that the Bekk smoothness is 500 seconds or more. Japanese Patent Application (OPI) No. 156086/78 describes that the surface roughness, Ra, of the heat sensitive color-forming layer is made to be less than 1.2 $\mu$m, and the glossiness less than 25%.

In all the above-described prior art techniques, the smoothness of the heat-sensitive color forming layer is increased only by calender processings such as super calendering, machine calendering, and gloss calendering. This calendering is applied to the base paper alone, or the base paper and the heat-sensitive paper, or the heat-sensitive paper alone. In the heat-sensitive recording paper, however, as the smoothness is increased by the calendering in order to increase the recording density, adherence and accumulation are increased. In practical use, therefore, the smoothness is suppressed to a suitable level so that the recording density and the occurrence of adherence and accumulation are properly balanced. In the prior art techniques, regardless of the smoothness level, the resulting heat-sensitive recording paper is unsuitable for practical use for high-speed recording in respect of recording density and recording stability.

The term "adherence" (sticking) as used herein refers to a phenomenon wherein the thermal head adheres to the heat-sensitive color-forming layer, thereby producing stripping noise and lowering the dot reproducibility. The term "accumulation" (piling) refers to a phenomenon wherein heat-melted products of the heat sensitive color-forming layer accumulate on the thermal head, thereby lowering the recording density and dot reproducibility. Both of these phenomena inhibit stable recording.

Another disadvantage as encountered in applying the calender processing to the heat-sensitive recording paper is that color fog is formed by pressure, resulting in an increase in the density of the background of the recording paper. Similarly, in the calendering processing of the base paper, so-called cockle, wrinkles, etc. due to unevenness in basis weight develop. Thus it is limited in its practical use. As described above, the attempt to increase the smoothness of the heat-sensitive color-forming layer by calendering processing so as to increase the recording density has met with only limited success, and the resulting heat-sensitive recording paper is not sufficiently satisfactory for use in high-speed recording.

SUMMARY OF THE INVENTION

An object of the present invention is to provide a heat-sensitive recording paper free from the above-described drawbacks, that is to say, where sticking of a heat-sensitive color-forming layer to a thermal head does not occur, and having excellent dot reproducibility and high density of recorded image even in high-speed recording.

As the result of our energetic research aimed toward obviating the foregoing defects, we have found that a heat-sensitive recording paper satisfying all of the foregoing characteristics can be obtained by using, as a paper support, a base paper coated with a subbing layer comprising a mixture of fine particles of a thermoplastic resin and a binder.

The above-described object of the present invention is attained by a heat-sensitive recording paper comprising a paper support having coated thereon a heat-sensitive color-forming recording layer, the paper support comprising a base paper onto which has been coated a subbing layer comprising a mixture of fine particles of a thermoplastic resin and a binder.

DETAILED DESCRIPTION OF THE INVENTION

The fine particles of a thermoplastic resin to be used in the present invention are obtained by finely granulating a thermoplastic resin having a molecular weight of 100,000 or more, such as polystyrene resin, styrene-acryl resin, acryl resin, polyethylene resin, polypropylene resin, polyacetal resin, chlorinated polyether resin, polyvinyl chloride resin, etc. Among these resins, styrene-acryl resin and polystyrene resin are preferred.

The size of these fine particles ranges from 0.05 to 5.0 μm, preferably from 0.1 to 1.0 μm, on the number average.

Further, it is preferably that the fine particles assume a hollow spherical form for the purpose of lowering the thermal conductivity of the subbing layer so that the heat supplied from a thermal head can be used effectively.

As for the binder to be used for dispersing the foregoing fine particles and forming the subbing layer, both hydrophobic and water-soluble polymers are suitable. In order to minimize the deterioration of plainness due to swelling of the base paper upon coating of a heat-sensitive color-forming layer, however, the binder preferably contains a hydrophobic polymer of 80 wt % or more.

Hydrophobic polymers with a glass transition point of −20° C. to 50° C. are preferred herein. They may be homopolymers or copolymers. In case of copolymers, those which as a whole are hydrophobic though they partly contain a hydrophilic repeating unit are suitable. As examples of such hydrophobic polymers, mention may be made of styrene-butadiene copolymers, methylmethacrylate-butadiene copolymers, acrylonitrile-butadiene copolymers, styrene acrylate copolymers, methylmethacrylate-acrylate copolymers, styrene-methacrylate-acrylate copolymers, etc.

For the purpose of controlling the coating aptitude of a composition for the subbing layer, it is also permitted to use a water-soluble polymer together with a hydrophobic polymer, provided that a proportion of the water-soluble polymer to a binder is not more than 20 wt %. Specific examples of water-soluble polymers suitable for the above purpose include starch, polyvinyl alcohol, carboxymethyl cellulose, hydroxyethyl cellulose, hydroxypropyl cellulose, casein, gelatin and the like.

In addition, pigment can be added to the coating composition for the subbing layer for the purpose of controlling the degree of oil absorption. Such pigments include inorganic ones, e.g., talc, clay, silica, kaolin, calcined kaolin, etc., and organic ones made of thermosetting resins, e.g., melamine resin, urea resin, phenol resin, etc. In order to maximize the effects of the present invention, however, it is preferred that the pigments should be used in a proportion of 30 wt % or less to the fine particles of a thermoplastic resin used.

A proportion of a binder to the fine particles of a thermoplastic resin is preferably 5 to 300 wt %, more preferably 20 to 100 wt %.

Further, a water resistance-imparting agent may be added to a coating composition for the subbing layer with the intention of improving a water resistance property of the subbing layer. As examples of such an agent, mention may be made of polyamide-polyamine-epichlorohydrin resin, melamin-formaldehyde resin, urea-formaldehyde resin, polyamide-polyurea resin, glyoxal resin, petroleum resin, and so on. Of these resins, polyamide-polyamine-epichlorohydrin resin and polyamide-polyurea resin, which are free from formaldehyde, are particularly preferred. The above-described water resistance-imparting agents are preferably used in a proportion of 0.1 to 10 wt %, particularly 0.5 to 5 wt %, to the amount of hydrophobic polymer used.

Suitable coating methods for applying the above-described composition for the subbing layer to base paper include a dip coating method, an air knife coating method, a curtain coating method, a roller coating method, a doctor coating method, and a gravure coating method.

A desirable coverage of the above-described coat to function as the subbing layer is within the range of 1 to 30 g/m$^2$, more preferably 5 to 20 g/m$^2$.

Moreover, it is preferably to subject the subbing layer to a calender processing with, e.g., a gloss calender or a super calender simultaneously with or subsequently to the coating thereof for the purpose of enhancing their smoothness of the paper support.

As for the base paper, those which have reduced the fluctuations in uneven formation, especially those controlled to 7% or less, preferably 5% or less, in the sum of fluctuations in uneven formation in a wavelength range of 12.5 to 80 mm , are preferred.

The present invention will be first described with reference to the definition of the fluctuations in uneven formation.

The measurement of formation was accomplished by means of Sheet Formation Tester (manufactured by Toyo Seiki Seisakusho K.K.). The fluctuations in uneven formation was accomplished by a weighing fluctuation process. Specifically, the fluctuations in the laser transmission of a paper is measured as a time series signal which is then statistically processed to obtain uneven formation in the equation defined below. This is accomplished by dividing the RMS (root mean square) value of the signal by the mean transmission to give fluctuation $F_T$ as follows:

$$F_T = \sqrt{\frac{1}{T} \int_0^T (f(t) - \bar{f}(t))^2 \, dt} \; / \bar{f}(t)$$

wherein f(t) represents the light transmission at a certain point on the paper; $\bar{f}(t)$ represents the average light transmission; and T represents the integrating time.

The measurement of formation is described in detail in *Convertech, (March* 1986, pp. 41–43, published by Converting Technology).

Moreover, it is desirable that the base paper used has such a degree of smoothness as to correspond to an optical surface roughness ($R_p$ value) of not more than 7 μm, more preferably not more than 4 μm.

Specific examples of the process for the preparation of base paper for heat-sensitive recording paper will be described hereinafter.

As pulp there may be used any of wood pulp such as LBKP(Laubholz Bleached Kraft Pulp), LBSP(Laubholz Bleached Sulfite Pulp), NBKP(Nadelholz Bleached Kraft Pulp), NBSP(Nadelholz Bleached Sulfite Pulp), LDP(Laubholz Dissolving Pulp), and NDP(Nadelholz Dissolving Pulp), or straw pulp, bagasse pulp, or linter pulp. Preferred among these pulps is LBSP and LDP. At least one of LBSP and LDP is preferably contained in the pulp in an amount of 10% by weight or more, and particularly preferably in an amount of from 20 to 60% by weight.

The content of Laubholz pulp obtained by adding LBKP to LBSP and LDP is preferably 90% by weight or more. The freeness of the pulp is generally 200 to 400 cc of C.S.F.(Canadian Standard Freeness), preferably 250 to 350 cc of C.S.F. For the length of pulp fiber which has been beaten, the sum of 24-mesh sieve residue and 42-mesh sieve residue in accordance with JIS-P-8207 sieve analysis is preferably in the range of from 20 to 50% by weight.

Examples of additives to be used in the present invention include: a sizing agent such as rosin, paraffin wax, a higher fatty acid salt, an alkenylsuccinate, an anhydrous fatty acid, a styrenemaleic anhydride copolymer, an alkylketene dimer, and an epoxidized fatty acid amide; a softening agent such as a reaction product of a maleic anhydride copolymer and a polyalkylenepolyamine, and a quaternary ammonium salt of higher fatty acid; a paper strength increasing agent such as polyacrylamide, starch, polyvinyl alcohol, gelatin, melamine-formaldehyde resin, urea formaldehyde resin, polyethylene imine resin, synthetic rubber latex, polyacrylic ester emulsion, and polyacetic vinyl emulsion; a fixing agent such as aluminum sulfate, aluminum chloride, and polyamide polyamine epichlorohydrine; a filler such as inorganic pigment (e.g., talc, clay, kaolin, calcined kaoline, diatomaceous earth, aluminum hydroxide titanium oxide, natural silica, synthetic silica, magnesium hydroxide, magnesium carbonate, calcium carbonate, and barium sulfate), and organic pigment (e.g., urea-formaldehyde resin, polystyrene resin, polyethylene resin, and acrylic resin); etc. Furthermore, if desired, the pulp composition may further contain a dye, a fluorescent dye, an antistatic agent, and a defoaming agent.

A dispersant such as polyethylene oxide, hydroxyl cellulose, and polyacrylamide may be preferably incorporated in the base paper for the purpose of improving the dispersibility of the paper material.

The paper may be preferably produced by using a shake, controlling a J/W ratio (i.e., ratio of speed of jet(J) of paper material to wire speed(W)) to between 0.9/1 and 1/1, using a dandy roll under wet condition, etc.

In order to further accomplish the effects of the present invention, the base paper is preferably calendered to obtain a density of from 0.9 to 1.1 g/cm$^3$, and particularly preferably from 0.95 to 1.05 g/cm$^3$, and a Bekk smoothness of 200 seconds or more, and particularly preferably 300 seconds or more. In order to prevent the base paper from deteriorating in surface flatness upon coating of a heat-sensitive coating solution, the Cobb-water absorption degree (defined by JIS-P-8140) thereof is 25 g/cm$^3$ or less, and preferably 20 g/m$^2$ or less.

The heat-sensitive coating solution to be used in the present invention is described below.

In the preparation of the heat-sensitive coating solution, a color former and a color developer each is separately dispersed in each aqueous solution of a water-soluble high molecular compound by means of ball mill or the like. The preparation of the desired particulate color former or color developer can be accomplished, for example, by dispersion with balls of different diameters in an appropriate mixing ratio for an appropriate period of time to obtain the desired particle attributes. Alternatively, a model sand mill (Dynomill ®), or the like may be effectively used.

The dispersion of the color former and the dispersion of the color developer thus prepared are mixed with each other. The admixture is then mixed with an inorganic pigment, a wax, a higher fatty acid amide, a metal soap, and if desired, an ultraviolet absorbent, an antioxidant, a latex series binder, or the like to provide the desired coating solution. These additives may be added to the above-described aqueous dispersion at dispersing the color former or the color developer.

The coating solution thus prepared is normally coated on the support in such a manner that the amount of the color former coated is from 0.2 to 1.0 g/m$^2$, and the amount of the color developer coated is from 0.1 to 2.0 g/m$^2$.

The color former to be used in the present invention is not specifically limited so long as it is for use in commonly used pressure-sensitive recording paper, heat sensitive recording paper, or the like.

Specific examples of such a color former include triarylmethane series compounds such as 3,3-bis(p-dimethylaminophenyl)-6 dimethylaminophthalide (i.e., Crystal Violet Lactone), 3-(p-dimethylaminophenyl)-3-( 1,2-dimethylindol-3-yl)phthalide, 3-(p-dimethylaminophenyl)-3-(2-phenylindol-3-yl)phthalide, 3,3-bis(p-ethylcarbazol-3-yl)-3-dimethylaminophthalide, and 3,3-bis-(2-phenylindol-3-yl)-5-dimethylaminophthalide; diphenylmethane series compounds such as 4,4-bis-dimethylaminobenzhydrinbenzyl ether, N-halophenylleucoauramine, and N-2,4,5-trichlorophenylleucoauramine; xanthene series compounds such as Rhodamine B-anilinolactam, 3-diethylamino-7-dibenzylaminofluoran, 3-diethylamino-7-butylaminofluoran, 3-diethylamino-7-(2-chloroanilino)fluoran, 3-diethylamino-6-methyl 7-anilinofluoran, 3-peperidino-6-methyl-7-anilinofluoran, 3-ethyl-tolylamino-6-methyl-7-anilinofluoran, 3-cyclohexyl-methylamino-6-methyl-7-anilinofluoran, 3-diethylamino-6-chloro-7-(β-ethoxyethyl-)aminofluoran, 3-diethylamino-6 chloro-7-(γ-chloropropyl)aminofluoran, 3-diethylamino-6-chloro-7-anilinofluoran, 3-N-cyclohexyl-N-methylamino-6-methyl-7-anilinofluoran, and 3-diethylamino-7-phenylfluoran; thiazine series compounds such as benzoyl leucomethylene blue, and p-nitrobenzoyl leucomethylene blue; and spiro series compounds such as 3-methylspirodinaththopyran, 3-ethylspirodinaphthopyran, 3-benzylspiro dinaphthopyran, 3-methylnaphtho-(3-methoxybenzo)-spiropyran, etc. They can be used singly or as a mixture thereof and are selected according to the intended uses and the desired properties.

As the color developers for use in the present invention, there are preferably used phenol derivatives of aromatic carboxylic acid derivatives, particularly bisphenols. Specific examples of the phenol derivatives include p-octylphenol, p-tert-butylphenol, p-phenylphenol-2,2-bis(p-hydroxy)propane, 1,1-bis(p-hydroxyphenyl)pentane, 1,1-bis(p-hydroxyphenyl)hexane, 2,2-bis(p-hydroxyphenyl)hexane, 1,1-bis(p-hydroxyphenyl)-2-ethylhexane, and 2,2-bis(4-hydroxy-3,5-dichlorophenyl)propane.

Specific examples of the aromatic carboxylic acid derivatives include p-hydroxybenzoic acid, propyl p-hydroxybenzoate, butyl p-hydroxybezoate, benzyl p-hydroxybenzoate, 3,5-di-α-methylbenzylsalicylic acid, and polyvalent metal salts thereof.

In order to melt and undergo color development reaction at a desired temperature, these color developers may be preferably incorporated in the above-described aqueous solution of a water-soluble polymer or binder in the form of an eutectic mixture with a low melting point heat-fusible material or in the form that a low melting point compound is fused onto the surface of the developer particles.

Specific examples of suitable waxes include paraffin wax, carnauba wax, microcrystalline wax, polyethylene wax, higher fatty acid amides such as stearic acid amide, and ethylene bisstearoamide, and higher fatty acid esters.

Specific examples of suitable metal soaps include polyvalent metal salts of higher fatty acids, such as zinc stearate, aluminum stearate, calcium stearate, and zinc oleate.

Specific examples of suitable inorganic pigments include kaolin, calcined kaolin, talc, agalmatolite, diatomaceous earth, calcium carbonate, aluminum hydroxide, magnesium hydroxide, magnesium carbonate, titanium oxide, and barium carbonate.

These inorganic pigments preferably have an oil absorption of 60 ml/100 g or more and an average particle diameter of 5 μm or less. Such an oil absorbing inorganic pigment may be preferably incorporated in the heat-sensitive color forming layer (i.e., recording layer) in a dried amount of from 5 to 50% by weight, and particularly preferably from 10 to 40% by weight.

These additives may be coated on the support in the form of a dispersion in a binder.

As the binder, there is normally used a water-soluble binder. Specific examples of the water-soluble binder include polyvinyl alcohol, hydroxyethyl cellulose, hydroxypropyl cellulose, an ethylene-maleic anhydride copolymer, a styrene-maleic anhydride copolymer, an isobutylene-meleic anhydride copolymer, polyacrylic acid, starch derivatives, casein, and gelatin.

In order to render these binders water-resistant, a water resistance imparting agent (e.g., gelling agent, crosslinking agent) or an emulsion of a hydrophobic polymer such as a styrene-butadiene rubber latex and an acrylic resin emulsion may be incorporated therein.

The binder is incorporated in the heat-sensitive recording layer in a dry weight of from 10 to 30% by weight. Furthermore, if desired, various aids such as a defoaming agent, a fluorescent dye, and a coloring dye may be properly incorporated in the coating solution.

In order to form such a recording layer, the coating of the coating solution on the support can be accomplished by any suitable known method, such as a blade coating method, an air knife coating method, a gravure coating method, a roll coating method, a spray coating method, a dip coating method, a bar coating method, and an extrusion coating method.

The amount of the coating solution to be coated on the support is not specifically limited but is normally in the range of from 3 to 15 g/m$^2$, and preferably from 4 to 10 g/m$^2$, calculated in terms of the dried coverage.

The effects obtained by the heat-sensitive paper of the present invention, in which a paper support having on a base paper a subbing layer comprising a mixture of fine particles of a thermoplastic resin and a binder is used, consist in an increase in the rate of contact with a thermal head, and uniform contact between them, thus achieving such a high density of recorded image as to be unattainable by conventional paper supports, and excellent dot reproducibility.

The present invention is further illustrated in the following example, but the present invention is not to be construed as being limited thereto. Unless otherwise indicated, all parts, percents and ratios are by weight.

EXAMPLE

(1) Preparation of Base Paper

A mixture of 60 parts of LBKP and 40 parts of LBSP was beaten with a disk refiner till it had a beating degree of 280 cc on a basis of Canadian Standard Freeness, and thereto were added 1.0 part of rosin as a sizing agent, 0.3 part of anion polyacrylamide, 5.0 parts of talc and 2.0 parts of aluminum sulfate. All the amounts of these additives are expressed in terms of the proportion to wood pulp on an absolute dry weight basis. The resulting composition was made into base paper with a basis weight of 65 g/m$^2$ and a thickness of 66 μm using a Fourdrinier paper machine. The paper making condition adopted was as follows: The J/W ratio was regulated to be 1.02; a shake and a dandy roll were used, and a calender processing was performed at 70° C. under a linear pressure of 210 Kg/cm. The smoothness of the base paper obtained was 4.9% expressed in terms of the sum of fluctuations in uneven formation at the wavelengths of 12.5 to 80 mm, and was 3.9 μm expressed in terms of the $R_p$ value. (This base paper was denoted A.)

Separately, 100 parts of LBKP were beaten with the disk refiner till its Canadian Standard Freeness became 300 cc, and thereto were added the same reagents in the same quantities as employed in making the base paper A. The resulting composition was made into base paper with a basis weight of 65 g/m$^2$ and a thickness of 67 μm using the Fourdrinier paper machine. The paper making condition adopted was as follows: The J/W ratio was regulated at 1.09; the shake was used, but the dandy roll was not used. The calender processing was performed at 35° C. under a linear pressure of 200 Kg/cm. The smoothness of the base paper obtained was 8.3 % expressed in terms of the sum of fluctuations in uneven formation at the wavelengths of 12.5 to 80 mm, and was 6.1 μm expressed in terms of the $R_p$ value. (This base paper was denoted B.)

Onto each of these base papers was coated each of the subbing layers having respective compositions as set forth in Table 1 using an air knife coater to prepare the paper supports according to the present invention. (Sample Nos. 1 to 5.)

Separately, a paper support without any subbing layer and other paper supports coated with subbing layers other than those of the present invention, were prepared for the purpose of comparison. (Sample Nos. 6 to 9)

Then, a heat-sensitive coating composition was coated onto each of the paper supports prepared in accordance with the present invention and for the purpose of comparison. The thus prepared heat-sensitive paper was subjected to a heat-sensitive recording procedure, and the densities of the recorded images were measured. In addition, the dot reproducibility in the area of recorded images with medium tone was evaluated by visual observation.

ciently subjected to dispersion to obtain the desired coating solution.

Coating Process

The coating solution thus prepared was coated on one side of the base paper samples by means of an air knife coater in an amount of 6 g/m$^2$. The coated samples were dried in a 50° C. hot air drier, and then machine-calendered.

Method for Measurement of Densities Achieved by Heat-Sensitive Recording

Color production in a solid condition was carried out at a recording speed of 2 milliseconds per dot, with a recording density of 5 dots/mm in the main scanning direction and that of 6 dots/mm in the sub-scanning direction, under thermal head energy of 50 milli joule/mm$^2$. Reflection densities at 610 nm were measured for evaluating the density of the recorded color.

TABLE 1

| Sample No. | Base Paper | Composition of Subbing Layer | | Coating Amount of Subbing Layer |
|---|---|---|---|---|
| 1 | A | (a) Fine particles of thermoplastic resin A (Voncoat pp-2000, produced by Dai-Nippon Ink & Chemicals, Inc.) | 100 parts | 13 g/m$^2$ |
| | | (b) SBR latex (Tg: −2° C.) | 30 parts | |
| 2 | A | (c) Fine particles of thermoplastic resin B (OP-42M, produced by Rohm & Haas Co.) | 100 parts | 12 g/m$^2$ |
| | | (d) MBR latex (Tg: = +3° C.) | 35 parts | |
| 3 | A | (e) Fine particles of thermoplastic resin C (OP-62, produced by Rohm & Haas Co.) | 100 parts | 13 g/m$^2$ |
| | | (f) SBR latex (Tg = 0° C.) | 25 parts | |
| 4 | B | (g) Fine particles of thermoplastic resin D (Voncoat pp-1000, produced by Dai-Nippon Ink & Chemicals, Inc.) | 100 parts | 12 g/m$^2$ |
| | | (h) SBR latex (Tg = 3° C.) | 30 parts | |
| 5 | B | (i) Fine particles of thermoplastic resin A (Voncoat pp-2000, produced by Dai-Nippon Ink & Chemicals, Inc.) | 100 parts | 12 g/m$^2$ |
| | | (j) Styrene-acryl copolymer Emulsion (Tg = +7° C.) | 30 parts | |
| 6 | B | Absent | | |
| 7 | B | (k) Clay | 100 parts | 12 g/m$^2$ |
| | | (l) SBR latex | 5 parts | |
| | | (m) Starch | 15 parts | |
| 8 | B | (n) Kaolin | 100 parts | 13 g/m$^2$ |
| | | (o) Polyvinyl alcohol | 5 parts | |
| | | (p) Starch | 15 parts | |
| 9 | B | (q) Urea-formaldehyde resin pigment | 100 parts | 12 g/m$^2$ |
| | | (r) Polyvinyl alcohol | 7 parts | |
| | | (s) Starch | 10 parts | |

Preparation of Heat-Sensitive Coating Solution

20 Kg of Crystal Violet Lactone was subjected to dispersion in a 10% aqueous solution of polyvinyl alcohol. (saponification degree: 98%; polymerization degree: 500) in a 300-liter ball mill for a 24-hour period. Similarly, 20 kg of 2,2-bis(4-hydroxyphenyl)propane was subjected to dispersion in a 10% aqueous solution of polyvinyl alcohol in a 300-liter ball mill for a 24 hour period. The two dispersions thus prepared were then mixed in a mixing ratio of 1/5 by weight as calculated in terms of the weight of Crystal Violet Lactone and 2,2-bis(4-hydroxyphenyl) propane. Precipitated calcium carbonate was added to the mixture in an amount of 5 kg per 20 kg of the latter. The admixture was suffi-

TABLE 2

| Sample No. | Density of Redorded Color | Dot Reproducibility | Remarks |
|---|---|---|---|
| 1 | 1.38 | Exceedingly excellent | Invention |
| 2 | 1.41 | Exceedingly excellent | Invention |
| 3 | 1.45 | Exceedingly excellent | Invention |
| 4 | 1.29 | Excellent | Invention |
| 5 | 1.31 | Excellent | Invention |
| 6 | 0.89 | Bad | Comparison |
| 7 | 1.03 | Good | Comparison |
| 8 | 1.08 | Good | Comparison |
| 9 | 1.12 | Good | Comparison |

Thermoplastic resins A and D:Styrene-acryl resins
SBR:Styrene-butadiene rubber
MBR:Methylmethacrylate-butadiene rubber It is apparent from the data of Table 2 that the heat-sensitive papers prepared in accordance with the present invention were superior in both recording density and dot reproducibility to conventional heat-sensitive papers.

While the invention has been described in detail and with reference to specific embodiments thereof, it will be apparent to one skilled in the art that various changes and modifications can be made therein without departing from the spirit and scope thereof.

What is claimed is:

1. A heat-sensitive recording paper comprising a paper support having coated thereon a heat-sensitive color-forming recording layer, said paper support comprising a base paper onto which has been coated a subbing layer comprising a mixture of fine particles of a thermoplastic resin and a binder, wherein said binder is comprised of a hydrophobic polymer in an amount of 80 wt % or more, and wherein said fine particles of thermoplastic resin are in the form of hollow spheres and wherein said heat-sensitive color-forming recording layer is coated directly on said subbing layer.

2. A heat-sensitive recording paper as in claim 1, wherein said base paper has uneven formation of a degree equal to 7% or less expressed in terms of the sum of fluctuations at the wavelengths ranging from 12.5 mm to 80 mm measured with a laser formation measuring apparatus.

3. A heat-sensitive recording paper as in claim 1, wherein the thermoplastic resin is selected from the group consisting of polystyrene resin, styrene-acryl resin, acryl resin, polyethylene resin, polypropylene resin, polyacetal resin, chlorinated polyether resin, and polyvinyl chloride resin.

4. A heat-sensitive recording paper as in claim 1, wherein the size of said fine particles of a thermoplastic resin is from 0.05 to 5.0 μm on the number average.

5. A heat-sensitive recording paper as in claim 4, wherein the size of said fine particles of a thermoplastic resin is from 0.1 to 1.0 μm on the number average.

6. A heat-sensitive recording paper as in claim 1, wherein said hydrophobic polymer is selected from the group consisting of styrene-butadiene copolymers, methylmethacrylate-butadiene copolymers, acrylonitrile-butadiene copolymers, styrene-acrylate copolymers, methylmethacrylate-acrylate copolymers and styrene-methylmethacrylate-acrylate copolymers.

7. A heat-sensitive recording paper as in claim 1, wherein said binder further comprises a water-soluble polymer in an amount of 20 wt % or less.

8. A heat-sensitive recording paper as in claim 7, wherein said water-soluble polymer is selected from the group consisting of starch, polyvinyl alcohol, carboxymethyl cellulose, hydroxyethyl cellulose, hydroxypropyl cellulose, casein and gelatin.

9. A heat-sensitive recording paper as in claim 1, wherein the proportion of said binder to said fine particles of a thermoplastic resin is from 5 to 300 wt %.

10. A heat-sensitive recording paper as in claim 9, wherein said proportion is from 20 to 100 wt %.

11. A heat-sensitive recording paper as in claim 1, wherein the subbing layer further comprises at least one of a water-soluble polymer, a pigment and a water resistance-imparting agent.

12. A heat-sensitive recording paper as in claim 1, in the density of said base paper is from 0.9 to 1.1 g/cm$^2$.

13. A heat-sensitive recording paper as in claim 12, wherein the density of said base paper is from 0.95 to 1.05 g/cm$^2$.

14. A heat-sensitive recording paper as in claim 1, wherein said base paper has a Bekk smoothness of at least 200 seconds.

15. A heat-sensitive recording paper as in claim 1, wherein aid color-forming recording layer comprises a color former, a color developer and a binder.

16. A heat-sensitive recording paper as in claim 15, wherein said color-forming recording layer is coated onto said paper support in an amount from 0.2 to 1.0 g/cm$^2$ based on the amount of the color former.

* * * * *